US005431107A

United States Patent [19]

Almaraz et al.

[11] Patent Number: 5,431,107

[45] Date of Patent: Jul. 11, 1995

[54] RAIL CLIP SETTER AND METHOD FOR FIXING SPRING CLIPS WITHOUT FULLY TENSIONING THE CLIPS ON THE RAILS

[75] Inventors: Roberto Almaraz; David Gustin; Robert Turner, all of Racine, Wis.

[73] Assignee: Racine Railroad Products, Inc., Racine, Wis.

[21] Appl. No.: 188,963

[22] Filed: Jan. 27, 1994

[51] Int. Cl.[6] ..... F01B 29/24

[52] U.S. Cl. ..... 104/2; 104/17.2

[58] Field of Search ..... 104/2, 9, 16, 17.1, 104/17.2, 307

[56] References Cited

U.S. PATENT DOCUMENTS

| | | | |
|---|---|---|---|
| 4,068,593 | 1/1978 | Leeves | 104/307 |
| 4,320,707 | 3/1982 | McIlrath | 104/17.2 |
| 4,479,440 | 10/1984 | Burr et al. | 104/17.2 X |
| 4,580,338 | 4/1986 | Badger | 29/759 |
| 4,669,387 | 6/1987 | Cassarini et al. | 104/17.2 |
| 4,733,614 | 3/1988 | Mohr et al. | 104/7.1 |
| 5,165,346 | 11/1992 | Piekarski | 104/17.2 |
| 5,191,838 | 3/1993 | Hansen | 104/2 |
| 5,269,225 | 12/1993 | Basshart et al. | 104/2 |

FOREIGN PATENT DOCUMENTS

| | | | |
|---|---|---|---|
| 1509900 | 9/1974 | United Kingdom | 29/24 |

OTHER PUBLICATIONS

Railway Gazette International, Apr., 1976 (one page).
Railway Gazette International, Nov., 1978 (one page).

*Primary Examiner*—Robert J. Oberleitner
*Assistant Examiner*—S. Joseph Morano
*Attorney, Agent, or Firm*—Nilles & Nilles

[57] ABSTRACT

A clip setting machine is capable of automatically separating individual spring-type rail clips from a stack of clips and of setting the individual clips in anchor sockets for subsequent application, e.g., by an automatic rail applicator. The clip setting machine may include two separate workheads each of which is positioned over a respective rail and which may support gauge and field side clip setter assemblies operable to set clips on the respective sides of a rail. Each clip setter assembly is movable from a position in which it receives clips one at a time from a magazine, through a position in which it is aligned with the shoulder of the anchor, and into a clip setting position. Each workhead can be lowered onto the rail into longitudinal alignment with the sockets and moved from tie to tie along the rail without being lifted, thereby facilitating the clip setting process. The clip setting process is preferably fully automated so that only two operators are required to operate the clip setting machine, one to load the magazines and one to position the machine and to initiate the clip setting cycle.

25 Claims, 12 Drawing Sheets

RAIL CLIP SETTER AND METHOD FOR FIXING SPRING CLIPS WITHOUT FULLY TENSIONING THE CLIPS ON THE RAILS

BACKGROUND OF THE INVENTION

1. Field of the Invention

The invention relates to a method and apparatus for laying and maintaining railways and, more particularly, relates to a method and apparatus for setting spring clips into anchor sockets to prepare the clips for subsequent application. 2. Description of the Related Art The use of spring clips to fasten rails to concrete or wooden ties is becoming increasingly popular. The clip most commonly employed is manufactured by Pandrol Incorporated of Bridgeport, New Jersey and is formed from a steel bar bent generally into the form of an "e" Such a clip, commonly known in the art as a "Pandrol e" clip, is used to fasten a rail to an anchor socket imbedded in a concrete or wooden tie by first loosely setting a center leg of the clip in the socket such that a toe of the clip loops back onto the base of the rail, and by then applying the clip by driving the clip further into the socket such that the clip applies substantial spring forces to the base of the rail.

The steps of setting and applying rail clips typically are performed independently of one another and have traditionally been performed manually with a first work gang manually setting the clips in the sockets and a second work gang driving the clips further into the sockets with sledge hammers. More recently, machines have been constructed which automatically apply clips after they have been manually set in the sockets. One such machine is disclosed in U.S. Pat. No. 4,320,707 to McIlrath (the McIlrath patent). The McIlrath patent discloses a clip applicator having arms which are mounted on a workhead and which can be hydraulically actuated to drive pincers into contact with a previously set clip to forcefully drive the clip into the socket, thereby applying the clip. While the clip applying machine disclosed by the McIlrath patent operates well, it still requires that clips be set in the sockets prior to application. This clip setting has heretofore been performed manually and thus is labor intensive.

Another machine, disclosed in U.S. Pat. No. 5,191,838 to Hansen (the Hansen patent), is designed to set and apply clips using a single machine. The machine disclosed by the Hansen patent includes a magazine, a clip shuttle which transfers clips from the magazine into alignment with anchor sockets, and a drive block which drives clips from the clip shuttles into the anchor sockets with sufficient force to apply the clips, applying the clips.

The machine disclosed by Hansen, though capable of applying clips which have not been previously set, exhibits several drawbacks and disadvantages. For instance, because the clip shuttle and drive block and associated components must be operated independently of one another yet must be capable of cooperating with one another at critical times, the machine disclosed by the Hansen patent is relatively large and complex. It also may be cost prohibitive to some customers, particularly those who already own a clip applicator and merely require a less labor intensive technique for setting clips.

OBJECTS AND SUMMARY OF THE INVENTION

It is therefore an object of the invention to provide an apparatus capable of automatically preparing rail clips for application by setting such clips in the sockets of rail anchors.

It is another object of the invention to provide an apparatus of the type described above which is relatively simple in construction and requires minimal labor to operate.

In accordance with a first aspect of the invention, these objects are achieved by providing an apparatus including a magazine which stores the clips and a clip setter assembly which receives the clips from the magazine and which sets the clips in the sockets without fully tensioning the clips onto the rail.

Preferably, the clip setter assembly comprises a clip setting tool which comprises 1) a clip holder which receives the clip from the magazine, 2) a pivotal clip retainer which selectively secures the clip in the clip holder for transport, 3) a support frame on which the clip setting tool is mounted for horizontal movement, 4) a guide block on which the support frame and the clip setting tool are mounted for vertical movement, 5) a clip setting cylinder which drives the support frame and the clip setting tool to move horizontally, and 6) a lift cylinder which drives the guide block, the support frame, and the clip setting tool to move vertically. A lateral adjustment bar, an adjustable retaining plate, and a support block may also be provided to assure proper positioning of the clip setter assembly with respect to the anchor sockets. The individual components of the clip setting machine are preferably controlled by pneumatic and/or hydraulic cylinders automatically controlled by flow switches or the like.

A clip dispensing assembly may also be provided and may include means for separating a clip from a stack of clips stored in the magazine, means for discharging the separated clip from the magazine, and means for conveying the separated clip from the magazine to the clip setter assembly.

Still another object of the invention is to provide an apparatus of the type described above which is capable of simultaneously setting clips in sockets positioned beside two rails and/or on opposite sides of the same rail.

In accordance with another aspect of the invention, this further object is achieved by providing a machine of the type described above and also having a support frame; one or more workheads which are mounted on the support frame, which are vertically moveable with respect to the support frame, and which are disposed above respective rails; rail head guide wheels, mounted on the workheads, for movably supporting the workheads on the heads of the rails; and rail clamps which clamp the workhead onto the rail. Separate magazines and clip setter assemblies are provided on gauge and field sides of each workhead for simultaneously setting four clips.

Yet another object of the invention is to provide a method of automatically setting a rail clip in an anchor socket, thereby preparing the clip for subsequent automatic or manual application.

In accordance with yet another aspect of the invention, this object is achieved by providing a method including feeding a rail clip from a magazine to a clip setting tool, moving the clip setting tool and the clip into alignment with the socket, and then moving the clip setting tool toward the socket so as to set the clip in the socket.

The feeding step preferably comprises lifting a stack of clips in the magazine off from the clip, then dispensing the clip from the magazine, and then conveying the clip from the magazine to the clip setting tool.

The setting step preferably includes moving a clip holder of the clip setting tool horizontally away from the magazine, then lowering the clip holder into alignment with the socket, and then moving the clip holder horizontally towards the socket to insert the clip into the socket.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout and in which.

DETAILED DESCRIPTION OF THE PREFERRED EMBODIMENT

1. Resume

Figure 1:
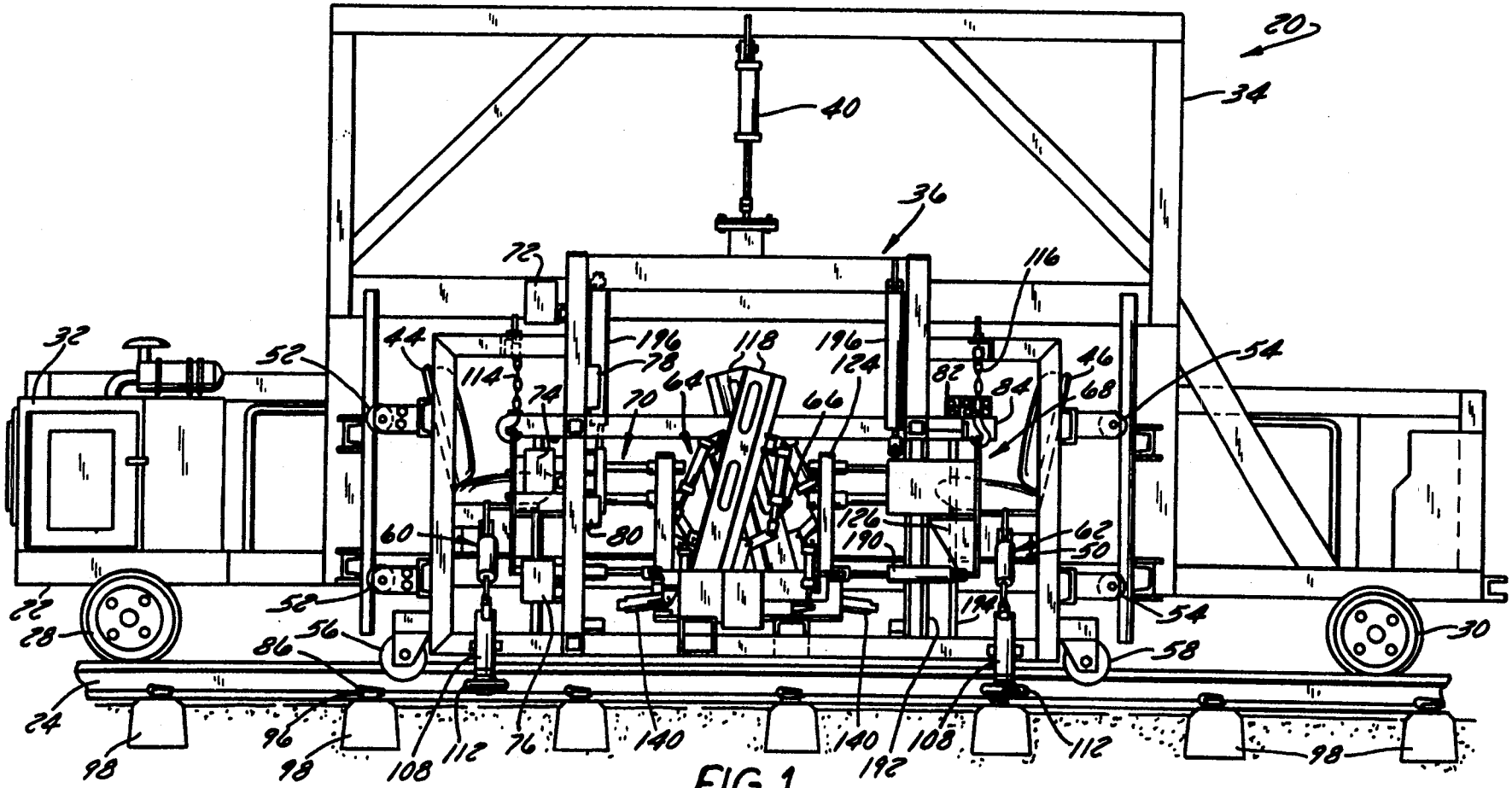
FIG. 1 is a side elevation view of a clip setting machine constructed in accordance with a preferred embodiment of the invention.
Figure 2:
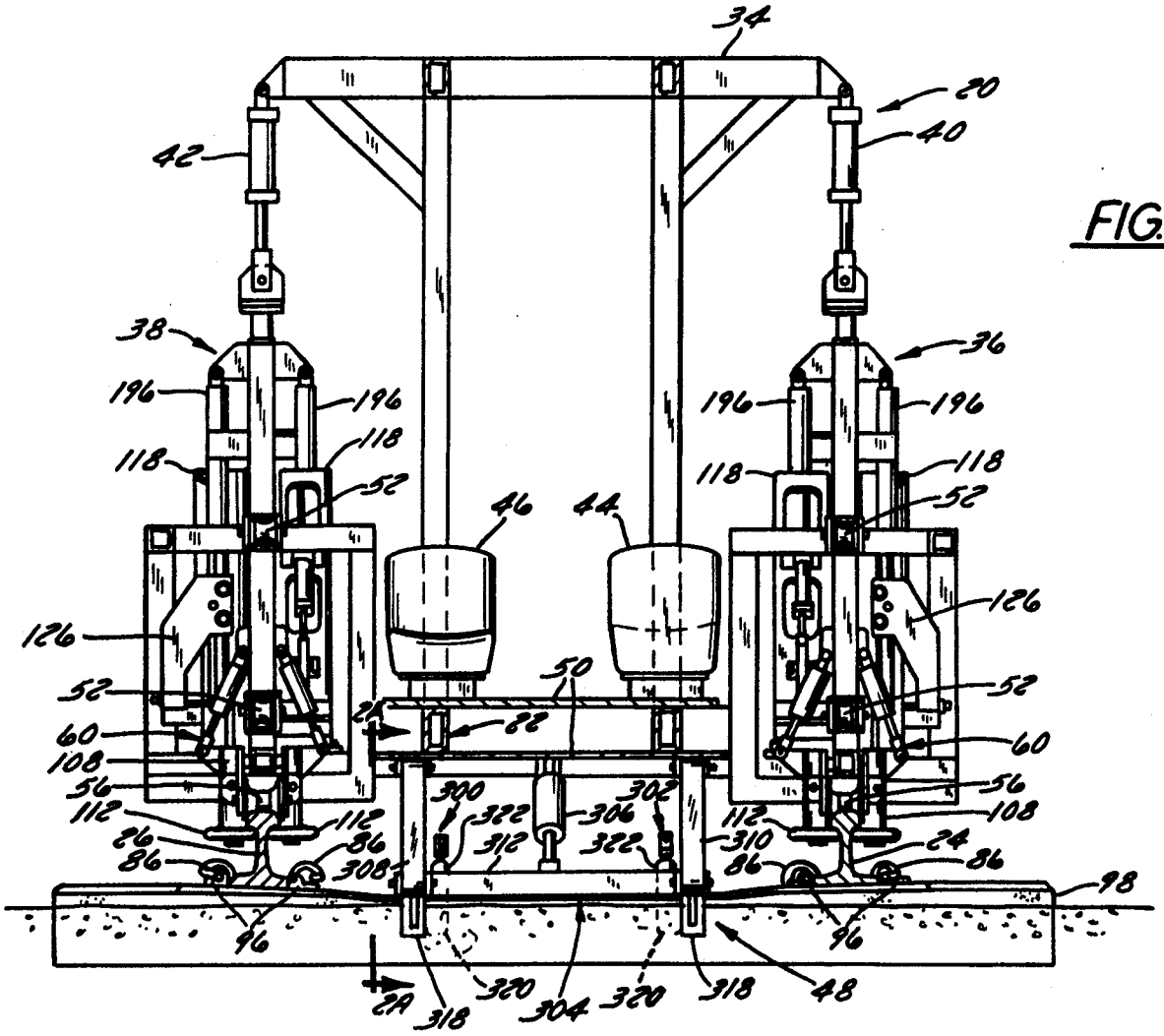
FIG. 2 is an end elevation view of the clip setting machine of FIG. 1.
Figure 2A:
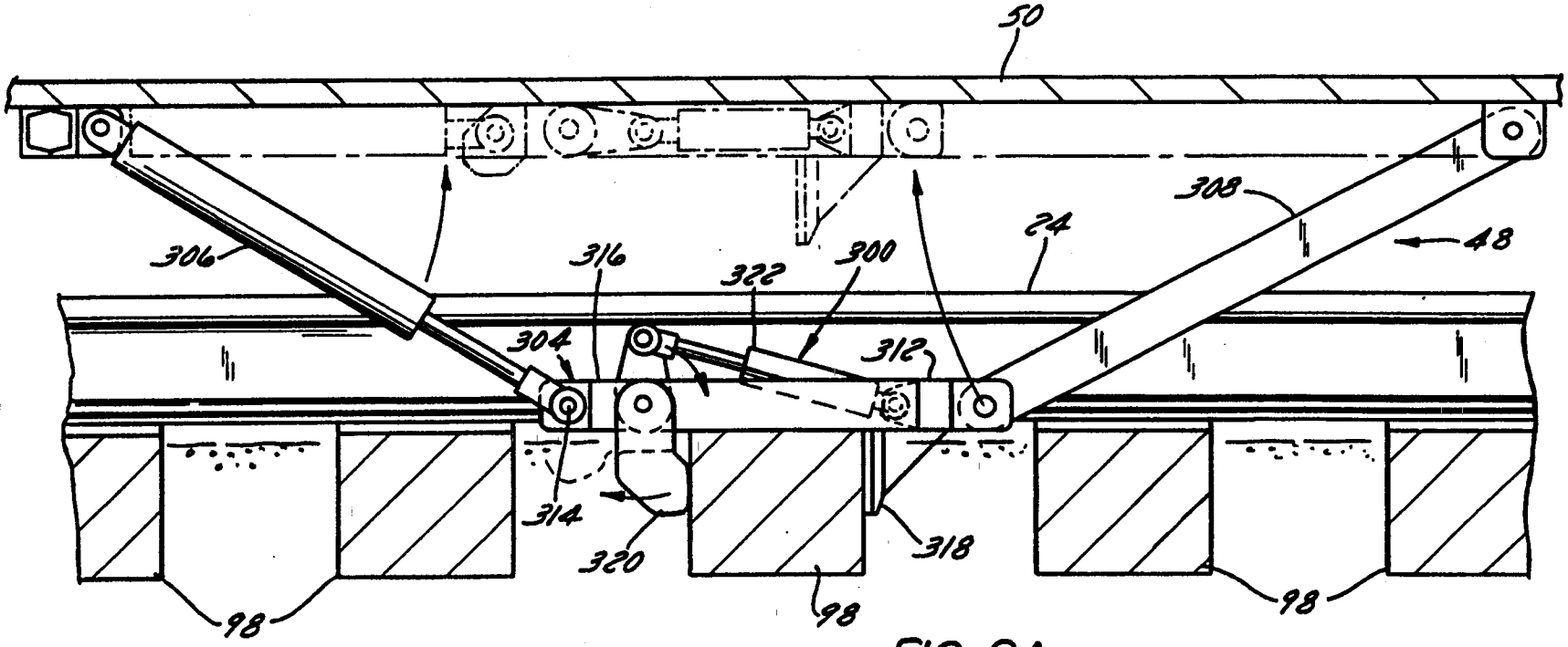
FIG. 2A is a sectional view taken along the lines 2A—2A in FIG. 2.

Pursuant to the invention, a clip setting machine is provided which is capable of automatically separating individual spring-type rail clips from a stack of clips and of setting the individual clips in anchor sockets for subsequent application, e.g., by a clip applicator. The clip setting machine may include two separate workheads each of which is positioned over a respective rail and which may support gauge and field side clip setter assemblies operable to set clips on the respective sides of a rail. Each clip setter assembly is movable from a position in which it receives clips one at a time from a magazine, through a position in which it is aligned with the clip socket of a tie or tie plate, and into a clip setting position. Each workhead can be lowered onto the rail into longitudinal alignment with the tie sockets and moved from tie to tie along the rail without being lifted, thereby facilitating the clip setting process. The clip setting process is preferably fully automated so that only two operators are required to operate the clip setting machine, one to load the magazines and one to position the machine and to initiate the clip setting cycle.

2. System Overview

Referring now to FIGS. 1–4, a clip setting machine 20 constructed in accordance with the present invention includes a self-propelled chassis 22 which is movably supported on rails 24, 26 by front and rear wheels 28, 30 and which is driven by hydraulic motors (not shown) which are in turn driven by and mounted to an engine 32. The chassis 22 presents a frame 34 having first and second workheads 36, 38 suspended therefrom by respective hydraulic lift cylinders 40, 42. Seats 44, 46 are supported on the frame 34 between the workheads 36, 38 to provide work stations for the operators. A tie alignment assembly 48 is suspended from a central portion 50 of the frame 34. Also mounted on each of the workheads are first, second, and third solenoid operated pneumatic valves 72, 74, 76, a pair of air manifolds 78, 80, and a hydraulic valve block 82 and an associated manifold 84.

Each of the workheads 36, 38 is of identical construction and is guided for vertical movement on the frame 34 by front and rear guide rollers 52, 54 and is guided for horizontal movement along the rails 24, 26 by front and rear railhead guide wheels 56, 58. Each workhead 36, 38 also receives front and rear clamp assemblies 60, 62 ("front" and "rear" as used herein denote the front of the machine 20, not the front of a particular workhead), field and gauge side clip dispensing assemblies 64, 66, and corresponding field and gauge side clip setter assemblies 68, 70.

Figure 5:
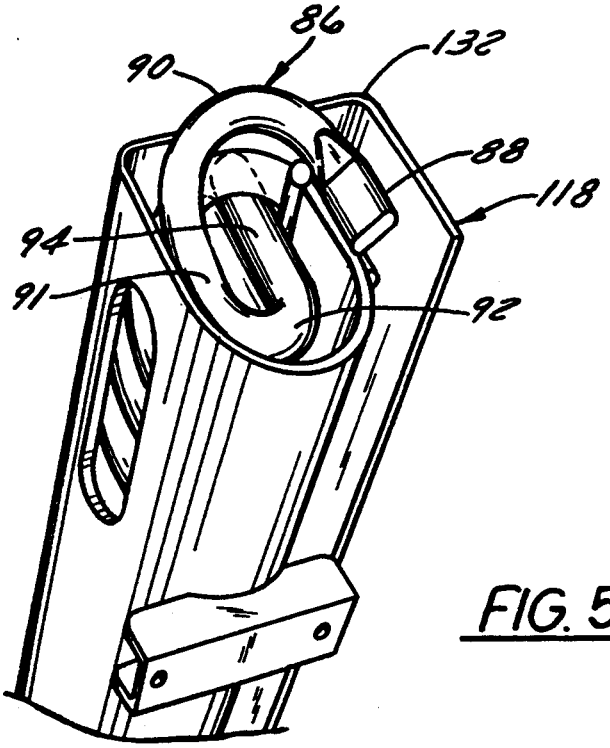
FIG. 5 is a perspective view of the upper portion of a magazine of the clip setting machine of FIGS. 1–4.

The clip setting machine 20 may be adapted to set virtually any spring-type rail clip in a socket to prepare the clip for subsequent application. One typical clip 86, known as a Pandrol e clip of the type discussed above and illustrated in some detail in FIGS. 5–7, takes the form of a generally cylindrical rod bent into a shape having a first free end portion 88 forming a toe, an outwardly curved front arch 90, a heel 91, a rearwardly curving rear arch 92, and a second free end portion forming a center leg 94 disposed generally between the toe 88 and the heel 91. The clips 86 are designed to attach the rails 24, 26 with tie socket 96 using spring forces. The sockets 96 are embedded in wooden or concrete ties 98 in a conventional manner. In its applied position, the heel 91 of each clip 86 rests upon a ledge 100 formed on the outer extent of a socket 102 of each tie socket 96 (FIG. 7), and the toe 88 extends inwardly over an insulator (not shown) resting on the base of the rail 24, 26. Substantial spring forces are applied to the base of the rail through the insulator by the toe 88 when the center leg 94 is driven into the tie socket 96 during the application process.

The tie alignment assembly 48 is designed to align the ties 98 with the workheads 36, 38 prior to a clip setting operation. Tie alignment is possible because ties 98 are usually only loosely set in the surrounding ballast when the rails 24, 26 are being laid. In fact, some or all of the ballast is often absent during rail laying. The ties 98 are thus free to move significantly with respect to the surrounding ballast. The tie alignment assembly 48 is designed to take advantage of this phenomenon.

The tie alignment assembly 48 comprises a pair of opposed tie locator assemblies 300, 302 which are mounted on a frame 304 which is in turn mounted on the chassis frame 50 by a front hydraulic lift cylinder 306 and a pair of rear arms 308, 310. Frame 304 includes a rear cross brace 312 pivotally connected to the arms 308 and 310 and a front rod 314 pivotably connected at its front end to the lift cylinder 306 and at its rear end to a central portion of cross brace 312. Each of the tie locator assemblies 300, 302 is of identical construction and comprises a horizontal support bar 316 connected to and extending forwardly from the rear cross brace 312 of frame 304, a rear clamping plate 318 extending downwardly from the support bar 316, and a front cam plate 320 mounted on the support bar 316 and pivotable by a hydraulic clamp cylinder 322 from an out of the way position to a tie clamping position.

In use, tie alignment assembly 48 is normally lifted by retraction of lift cylinder 306 to a raised position in which the lift cylinder 306 and arms 308, 310 and the support bar 316 of each of the tie locator assemblies 300, 302 are generally parallel with one another and abut the bottom surface of chassis frame 50. Cam plate 320 is also retracted by retraction of clamp cylinder 322. A clearance of about 3" is provided between the bottoms of the rear clamping plates 318 and the rails 24 when the assembly 48 is in this position, thus precluding the machine 20 from catching on the rails. When tie positioning is desired, the machine 20 is positioned over a tie 98, and the lift cylinder 306 is extended to lower the locator assemblies 300, 302 to a position in which the rear clamping plates 318 abut or are disposed adjacent to the rear face of the tie 98. Clamp cylinders 322 are then actuated to pivot the cam plates 320 into contact with the front face of the tie 98 with sufficient force to shift the tie 98 into a position in which the tie 98 is securely clamped between the cam plates 320 and clamping plates 318 of the tie locator assemblies 300, 302 in alignment with the clip setting assemblies.

The vertical guide rollers 52, 54, guide wheels 56, 58, and clamp assemblies 60, 62 permit the workheads 36, 38 to be supported on the rails 24, 26 during normal use. Thus, (referring to FIGS. 2 and 8) the clamp assemblies 60, 62 of each workhead each include clamping arms 108 pivotally mounted on opposed sides of the workhead frame. The clamping arms 108 of each clamp assembly has an upper end attached to a clamping cylinder 110 and a lower end receiving a clamping roller 112. Each clamping cylinder 110 has a cylinder portion pivotally connected to the workhead frame and a piston porEion pivotally connected to the upper end of the clamping arm 108. The clamping roller 112 of each clamp assembly 60, 62 is rotatably mounted on the second end of the clamping arm 108 so as to roll along the rail 24, 26 during transport while at the same time assuring that the workhead 36, 38 is clamped in place directly above the rail 24, 26.

In use, the clip setting machine 20 is usually transported to the workplace with the workheads 36, 38 in their raised positions and with independent lowering of the clip setter assemblies 68, 70 being prevented by safety chains 114, 116 connecting the clip setter assemblies 68, 70 to the workheads 36, 38. The workheads 36, 38 are then lowered onto the rails 24, 26 by operation of the lift cylinders 40, 42, and the clamping cylinders 110 are then actuated to clamp the workheads 36, 38 to the rails 24, 26. The safety chains 114, 116 are then detached from the clip setter assemblies 68 and 70, and the clip setting machine 20 is driven from tie to tie to permit the clips 86 to be set in the tie sockets 96 as detailed below.

Each of the clip setter assemblies 68, 70 is adapted to receive clips 86 dispensed from a stack of clips by an associated clip dispensing assembly 64, 66, and to insert the thus received clips 86 in tie sockets 96. Each of the clip setter assemblies 68, 70 is of identical construction with the orientation of the gauge and field side clip setter assemblies 68, 70 of each of the workheads 36, 38 and of the corresponding clip dispensing assemblies 64, 66 being reversed for proper clip insertion. Thus, the following description of the field side clip setter assembly 68 of workhead 36 and of the corresponding clip dispensing assembly 64 is equally applicable to the corresponding gauge side clip setter assembly 70 and associated clip dispensing assembly 66 of the workhead 36 and for both clip dispensing and clip setting assemblies of the other workhead 38.

3. Construction of Clip Dispensing Assembly and Clip Setter Assembly

Referring now to FIGS. 1–10, the clip dispensing assembly 64 may be any assembly adapted to store clips and to selectively supply them one at a time to the corresponding clip setter assembly 68. The clip setter assembly 68 may be any assembly adapted to receive individual clips from clip dispensing assembly 64 and to set the individual clips in tie sockets 96. Pneumatic and hydraulic circuits 250 and 300 are provided for actuating various components of the clip dispensing assembly 64 and clip setter assembly 68.

In the illustrated embodiment, each clip dispensing assembly 64 comprises a magazine 118 adapted to store a stack of clips 86, and a roller conveyor 120 adapted to transfer individual clips from the magazine 118 to the clip setter assembly 68, 70. The magazine 118 and roller conveyor 120 are mounted on a common support frame 128 which is in turn bolted to slots (not shown) in a support block 130 so as to be laterally movable with respect to the support block 130 to permit lateral adjustment of the position of the clip dispensing assembly 64.

Referring now especially to FIGS. 5, 8, 9 and 10, the magazine 118 preferably takes the form of a generally eshaped metal tube having an upper inlet 132 and a lower outlet 134 selectively closed by a trap door assembly 136. The tube permits as many as fifteen (15) clips to be stacked in the magazine 118 with their toes 88 and heels 91 facing the clip setter assembly 68, 70 and with their front arches 90 and center legs 94 facing tie socket 96. The trap door assembly 136 comprises a plate 138 which is pivotally attached to the lower end of magazine 118 and which, upon retraction of a pneumatically actuated dispensing cylinder 140, discharges a clip 86 onto the roller conveyor 120. Also provided on the magazine 118 are opposed clip stack support assemblies 142, 144 each of which includes a clip latch 146 pivotally mounted onto the magazine 118. Each clip latch 146 has a head extending into the magazine 118 and a tail extending away from the magazine and attached to a respective pneumatically operated clip stack support cylinder 148. Each of the clip latches 146 is movable, upon retraction of the associated clip stack support cylinder 148, from the position illustrated in phantom lines in FIG. 8 allowing unimpeded movement of the clips 86 through the magazine 118 to the position illustrated in solid lines in FIG. 8 in which it lifts the remaining clips 86 of the stack from the bottom clip to permit dispensing of the bottom clip 86 from the magazine 118.

Figure 6:
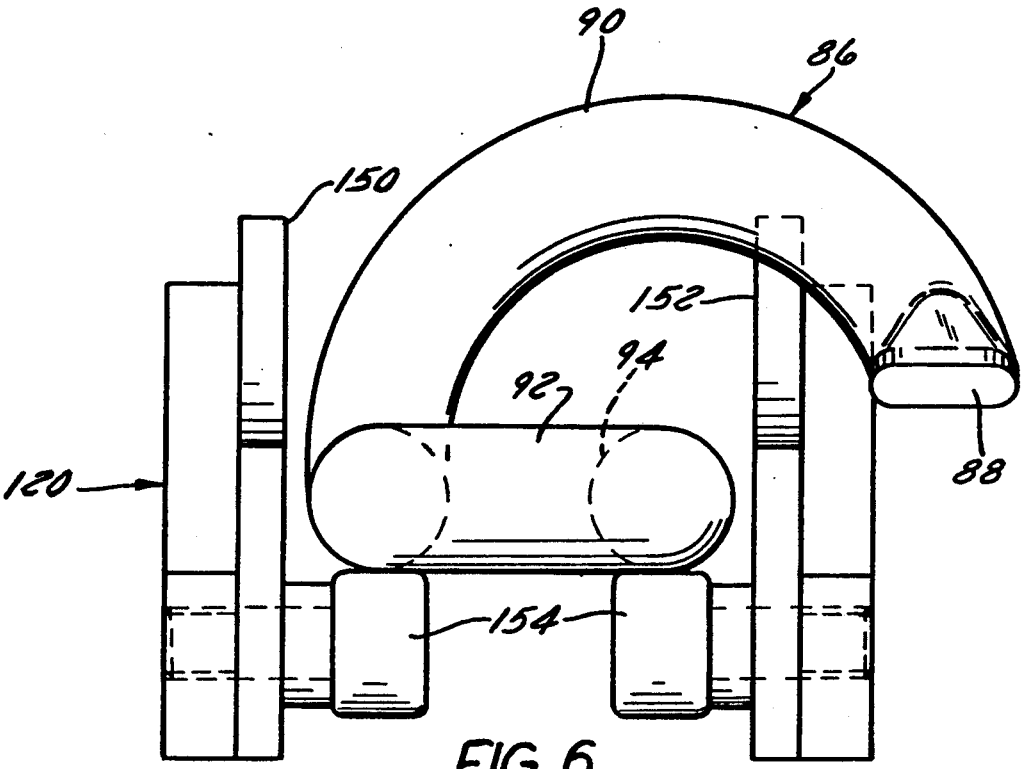
FIG. 6 is a perspective view illustrating the feed of a clip along a roller conveyor of the clip setting machine of FIGS. 1–4.
Figure 8:
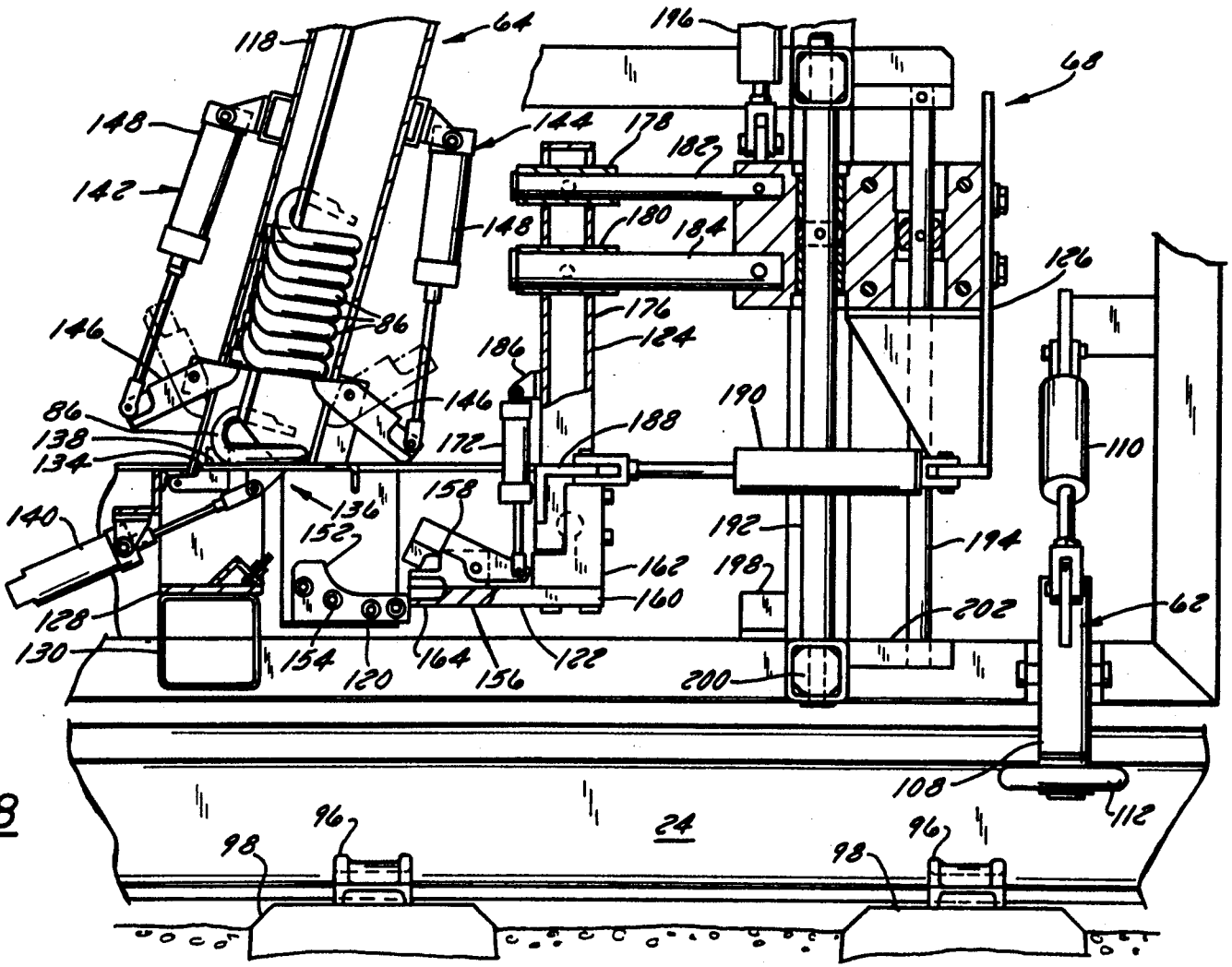
FIG. 8 is a partially sectional side elevation view of a clip setter assembly and clip dispensing assembly of the clip setting machine of FIGS. 1–4 and illustrating the assemblies prior to a dispensing operation.

Referring now to FIGS. 6 and 8, the roller conveyor 120 is preferably formed from opposed support plates 150, 152 and a plurality of rollers 154 mounted on the support plates 150, 152 so as to form a sloped rolling support surface for conveying the clips 86. Portions of the support plates 150, 152 extend above the rollers 154 so as to act as guide surfaces for the clips 86 as the clips travel along the conveyor 120.

The clip setter assembly 68 preferably comprises a clip setting tool 122 for receiving individual clips from the roller conveyor 120 and for setting the clips 86 in tie sockets 96, a support frame 124 on which the clip setting tool 122 is mounted for horizontal movement with respect to the workhead 36, and a guide block 126 on which the support frame 124 and clip setting tool 122 are mounted for vertical movement with respect to the workhead 36. The clip setting tool 122 preferably comprises a clip holder 156 and a clip retainer 158 cooperating so as to receive individual clips from the roller conveyor 120 and to transport the individual clips to the tie sockets 96 and to insert clips in the tie sockets 102.

Figure 7:
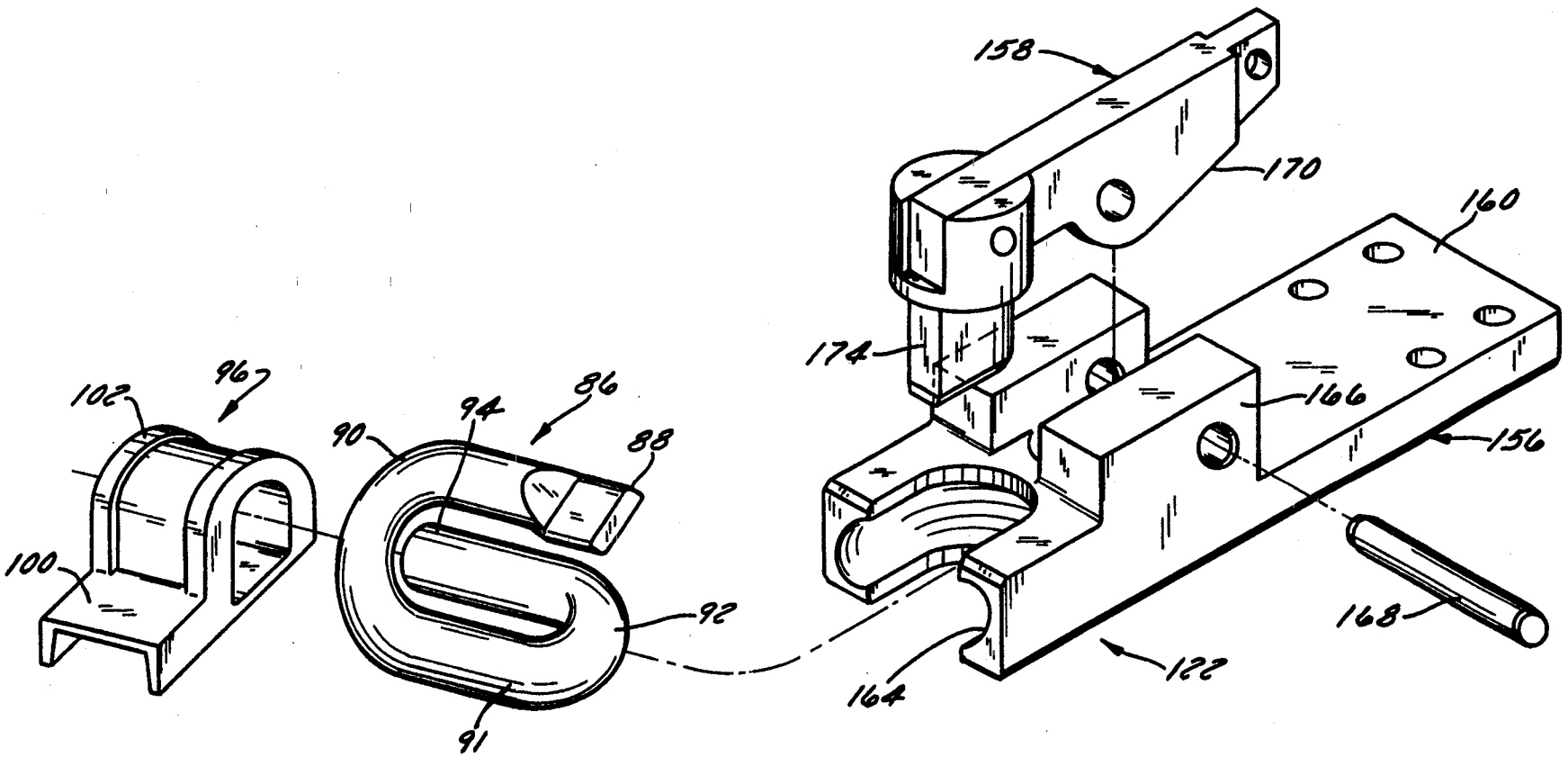
FIG. 7 is an exploded perspective view illustrating the relationship between a clip setting tool, a clip, and a clip anchor socket.
Figure 9:
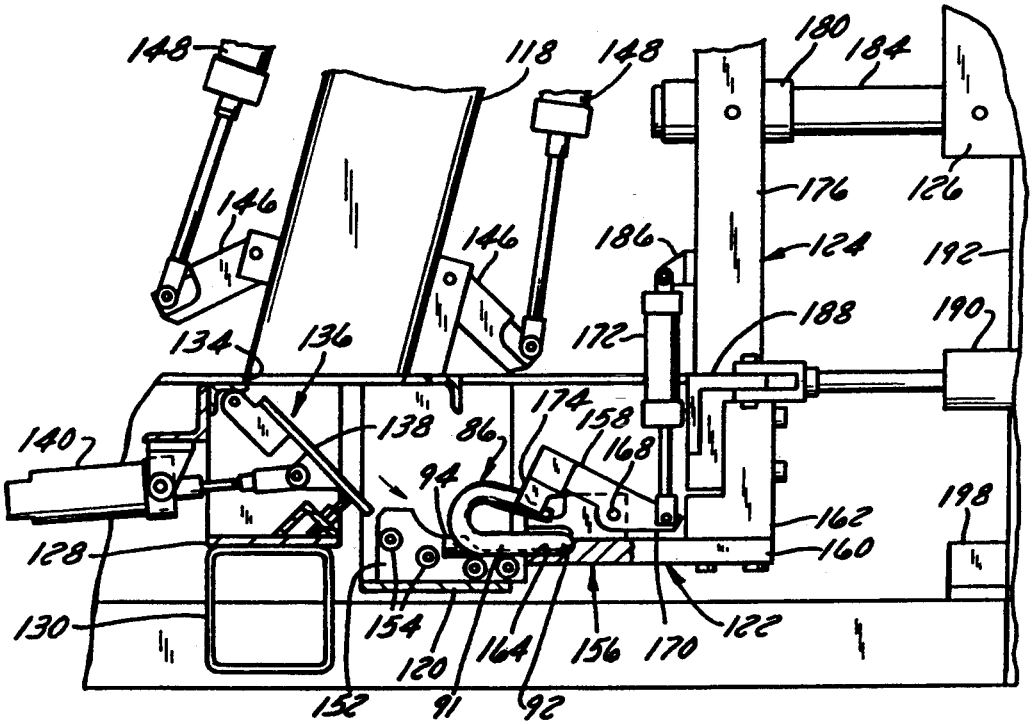
FIGS. 9–12 generally correspond to FIG. 8 and illustrate the operation of the clip setter and dispensing assemblies.
Figure 10:
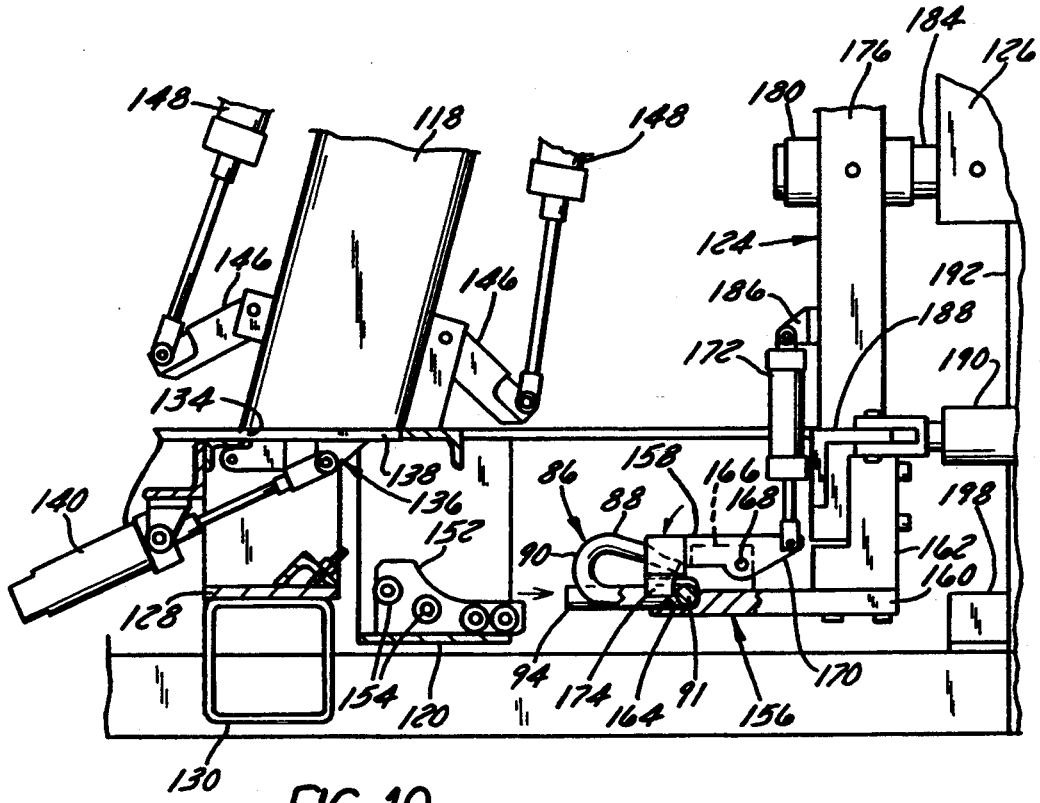
Figure 11:
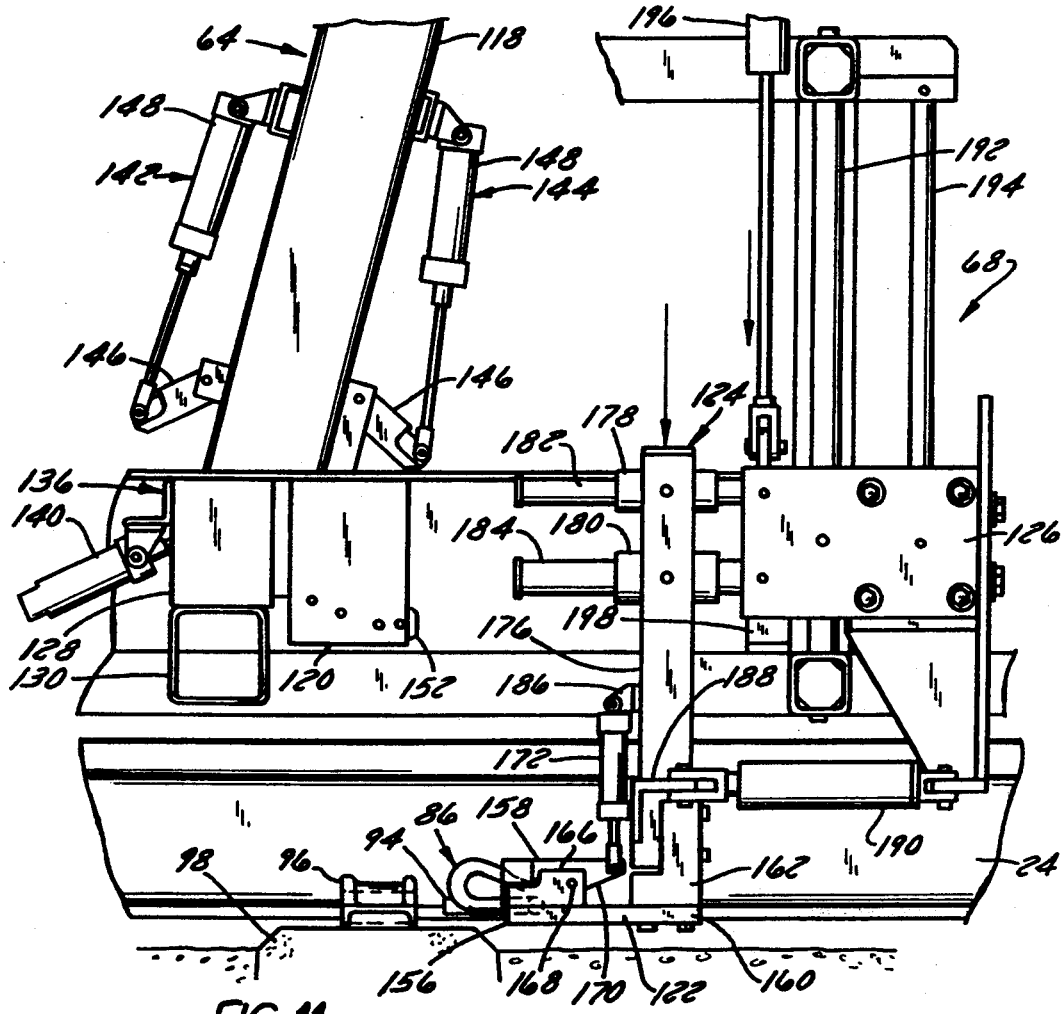
Figure 12:
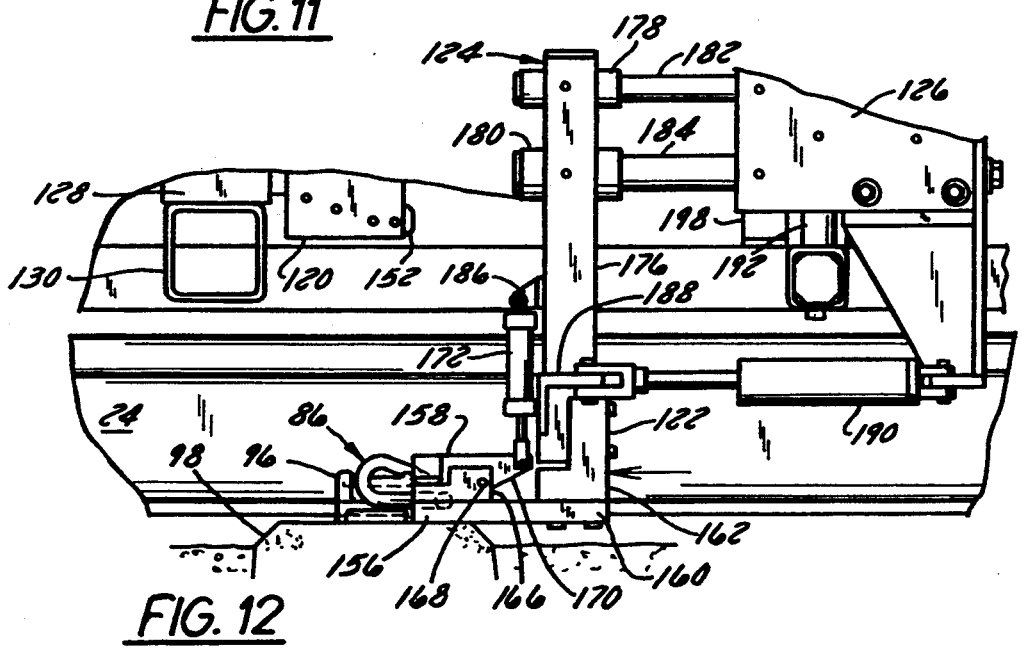

Referring now to FIGS. 7–12, the clip holder 156 includes a generally horizontal plate 160 supporting the clip retainer and a generally vertical plate 162 having a lower end bolted to the horizontal plate 160 and an upper end bolted to the support frame 124. The horizontal plate 160 has a front socket 164 (FIG. 7) which has a shape complimenting that of the rear arch 92 of the clip 86 and which is adapted to receive individual clips 86 as illustrated in FIGS. 7 and 9–10. A clevis 166 extends upwardly from the horizontal plate 160 behind the front socket 164 and is pivotally connected to the clip retainer 158 via a pivot pin 168.

The clip retainer 158 includes a support arm 170 (Fig. 7) which (1) is mounted on the horizontal plate 160 of the clip holder 156 by the pivot pin 168 at a central portion thereof, (2) is connected to a retaining cylinder 172 at a rear end thereof, and (3) receives a clip latch member 174 at a front end thereof. The clip latch member 174 is operable, upon retraction of the retaining cylinder 172 and corresponding pivotal movement of the support arm 170, to engage the rear arch 92 of the clip 86, thereby holding the clip 86 in position.

The support frame 124 is designed to support the clip holder 156 for vertical and horizontal movement with respect to the workhead 36 and includes a generally vertical tube 176 supporting upper guide sleeves 178, 180 for receiving stabilizer rods 182, 184. Also mounted on the support frame 124 are a bracket 186 for supporting the retaining cylinder 172, and a bracket 188 for supporting the first end of a clip setting cylinder 190. The remote ends of both the clip setting cylinder 190 and the stabilizer rods 182, 184 are connected to the guide block 126 so as to permit horizontal movement of the clip setting tool 122 and support frame 124 along the stabilizer rods 182, 184 upon actuation of the clip setting cylinder 190.

The guide block 126 is designed to support the support frame 124 and thus the clip setting tool 122 for vertical movement with respect to the workhead 36 and to permit adjustment of the clip setting tool 122 with respect to the workhead. To this end, the guide block 126 receives the stabilizer rods 182, 184 as discussed above and is mounted on front and rear vertical guide rods 192, 194 so as to move vertically along the guide rods 192, 194 upon actuation of a hydraulic lift cylinder 196 connected to the guide block 126 and to the frame of the workhead 36. Lowering of the guide block 126 with respect to the workhead 36 is limited by a support block 198 the height of which is preferably adjustable, e.g., by turning the block 198 on its side. Adjusting the extent of travel of the guide block 126 in this manner permits vertical adjustment of the clip setting tool 122 and thus permits alignment of the setting tool 156 with tie sockets of different configurations. The front and rear guide rods 192, 194 are bolted to a lateral adjustment bar 200 and to a retaining plate 202, respectively, to permit positioning of the guide block 126 and thus of the clip setting tool 122 with respect to the tie sockets 96. That is, the front guide rod 192 is bolted to a slot in lateral adjustment bar 200, and the retaining plate 202 receiving the rear guide rod 194 is bolted to a slot in the frame of the workhead 36. The front and rear guide rods 192, 194 can thus be moved together to permit lateral positioning of the entire clip setter assembly 68 just as the position of the clip dispensing assembly 64 can be adjusted as discussed above. Alternatively, the retaining plate 202 can be moved independently of the lateral adjustment bar 200 so as to cause the guide block 126, support frame 124, and clip setting tool 122 to pivot about the front guide rod 192, thus changing the angle of the clip setting tool 122 with respect to the rail 24. This may be necessary in some instances in which the rail 24 is canted with respect to the ties 98.

4. Operation of Clip Dispensing Assembly and Clip Setter Assembly

In operation, after the clip setting machine 20 is transported to the work site and mounted on the rails 24, 26, the workheads 36, 38 are lowered onto the rails 24, 26, clamped to the rail, and positioned over a tie 98 as discussed above. The cylinders 306 and 322 of the tie alignment assembly 48 are then actuated to align the tie 98 with respect to the workheads 36, 38 as described above. These operations, as well as initiation of the clip setting sequence, are preferably performed by a first operator seated in seat 46. Meanwhile, a second operator, positioned in seat 44, simultaneously loads two magazines 118 with clips 86. A clip setting sequence then takes place as follows:

First, the clip stack support cylinders 148 are retracted from their inactive position illustrated in phantom lines in FIG. 8 to their active positions lifting the remaining clips of the stack from the bottom clip 86. The dispensing cylinder 140 is then actuated to open the trap door assembly 136 to dispense the bottom clip 86 onto the roller conveyor 120. The clip 86 then rolls along the roller conveyor 120 and into the socket 164 of the clip holder 156, thus completing the dispensing operation as illustrated in FIG. 9.

The clip setting operation is then initiated by retracting the retaining cylinder 172 to pivot the clip retainer 158 into its clip retaining position. The clip setting cylinder 190 is then retracted to move the support frame 124 and clip setting tool 122 horizontally away from the roller conveyor 120 to permit unhindered lowering of the clip setting tool 122 as illustrated in FIG. 10. The lift cylinder 196 is then actuated to lower the guide block 126, support frame 124, and clip setting tool 122 to the position illustrated in FIG. 11 in which the clip 86 is horizontally aligned with the tie socket 96. Then, the clip setting cylinder 190 is again extended to move the clip setting tool 122 in the direction of the arrow in FIG. 12 to insert the clip 86 into the tie socket 96. It should be emphasized that this insertion does not actually "apply" the clip in that it does not apply significant tensioning forces to the clip. It merely sets the clip 86 in the socket 102 to permit application of the clip either manually or by an automatic device such as the one disclosed in the McIlrath patent cited above.

After the clip 86 is set, the retaining cylinder 172, clip setting cylinder 190, and lift cylinder 196 are retracted in sequence, and the clip setting cylinder 190 is again extended to prepare the clip setter assembly 68 for receiving the next clip. Dispensing cylinder 140 is also extended and the clip stack holding cylinders 148 retracted during this operation to ready the clip dispensing assembly 64 for the next dispensing cycle.

The clip setting sequence described above could take place manually via operation of levers or switches controlling operation of the respective cylinders. However, the sequence is preferably performed automatically upon actuation of a suitable switch or lever, with suitable switches or sensors controlling the sequence of the remaining operations. An especially preferred sequencing structure and method will now be described.

5. Construction and Operation of Pneumatic and Hydraulic Control Circuits

Figure 3:
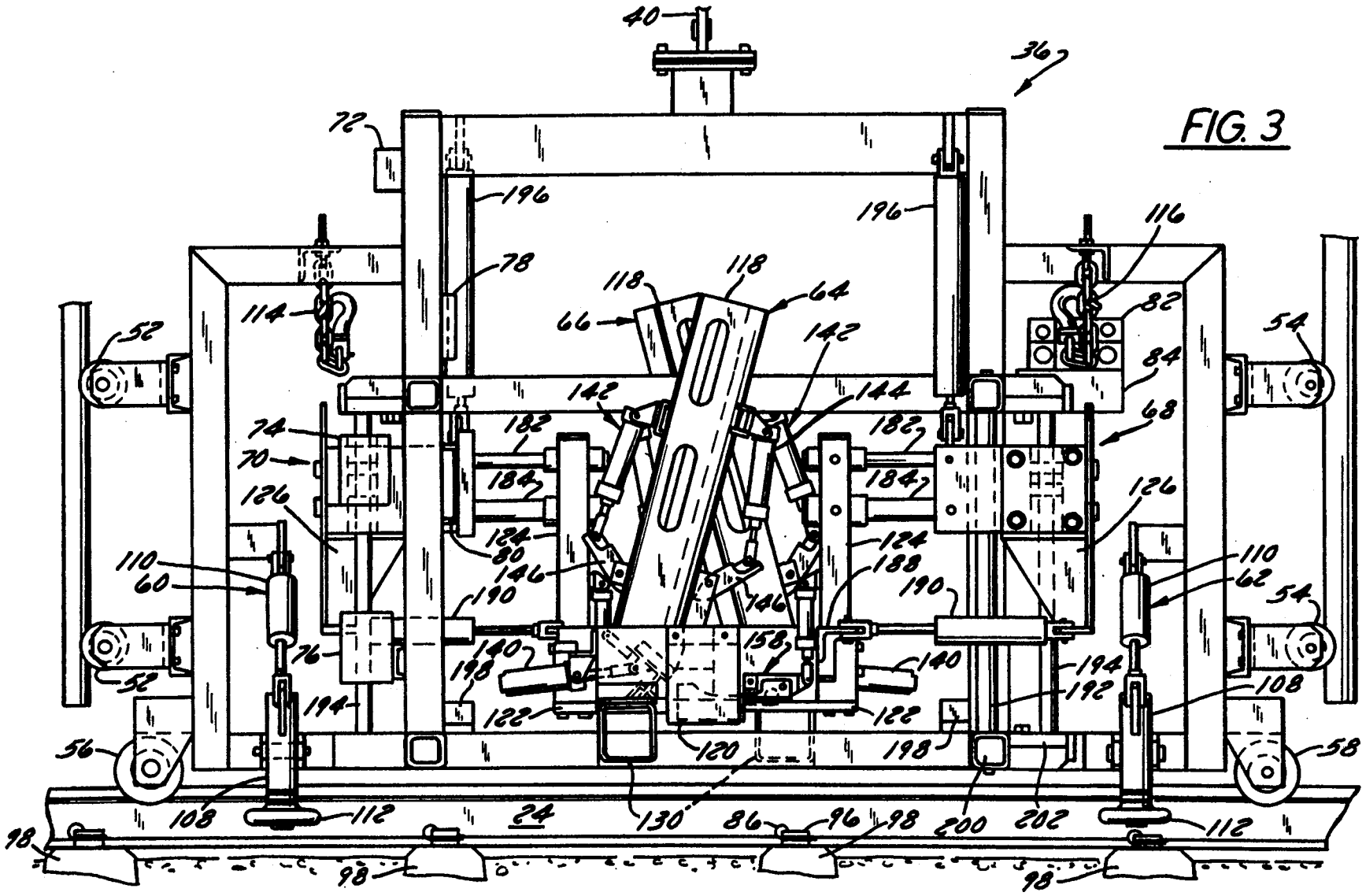
FIG. 3 is a side elevation view of a first workhead of the clip setting machine of FIGS. 1 and 2.
Figure 4:
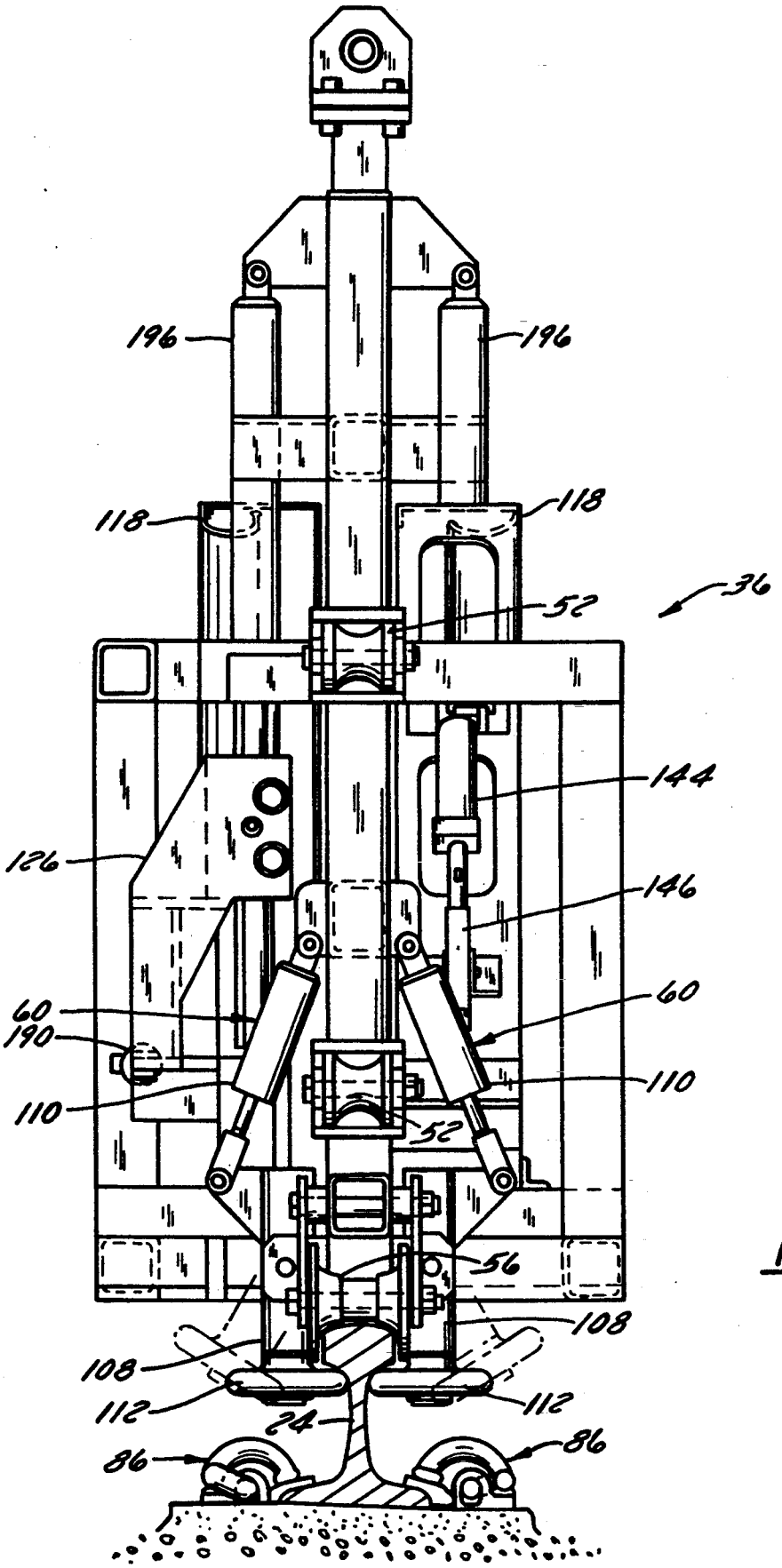
FIG. 4 is an end elevation view of the workhead of FIG. 3.
Figure 13:
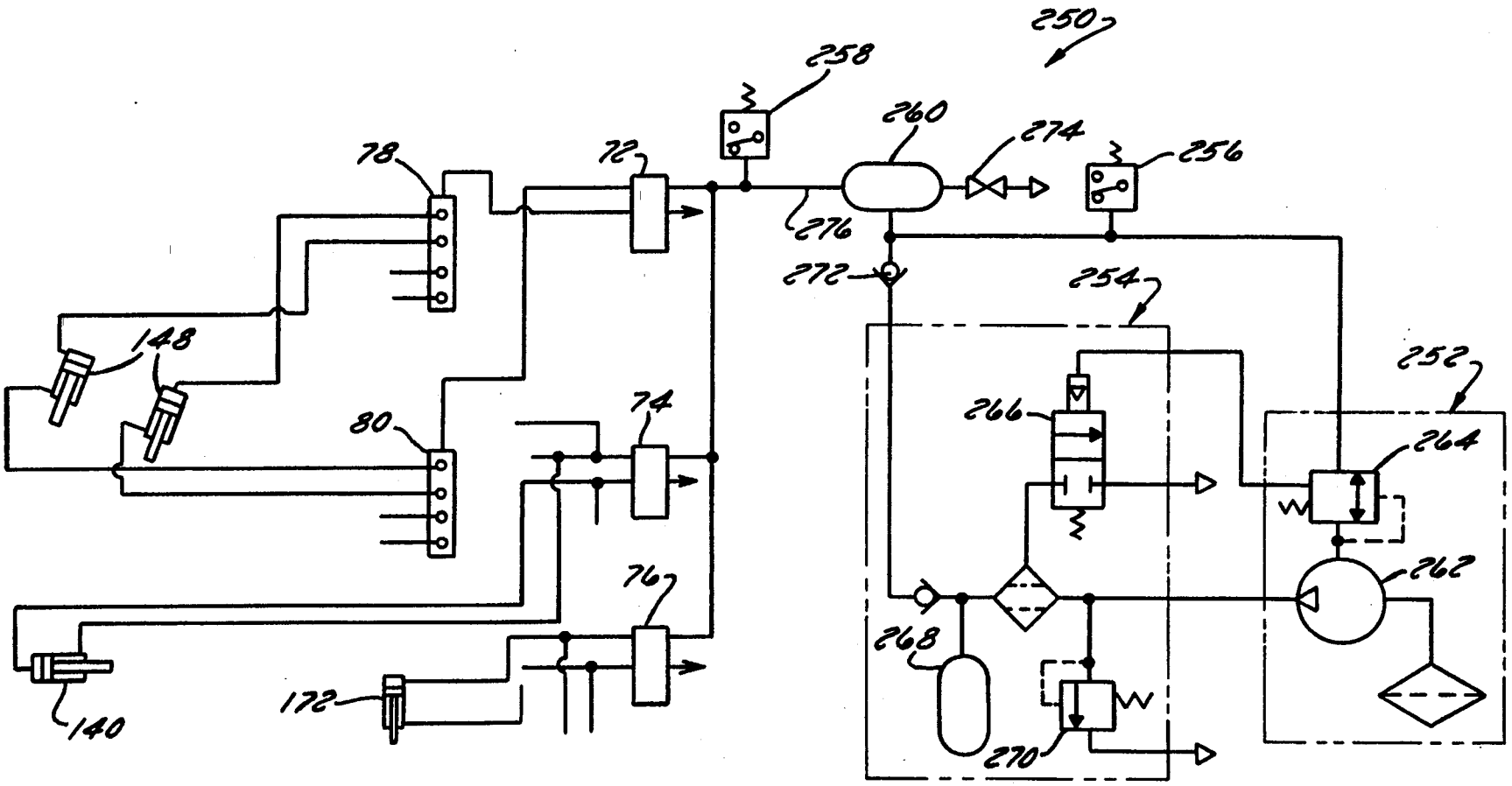
FIG. 13 is a pneumatic circuit diagram of the clip setting machine of FIGS. 1–12.
Figure 14:
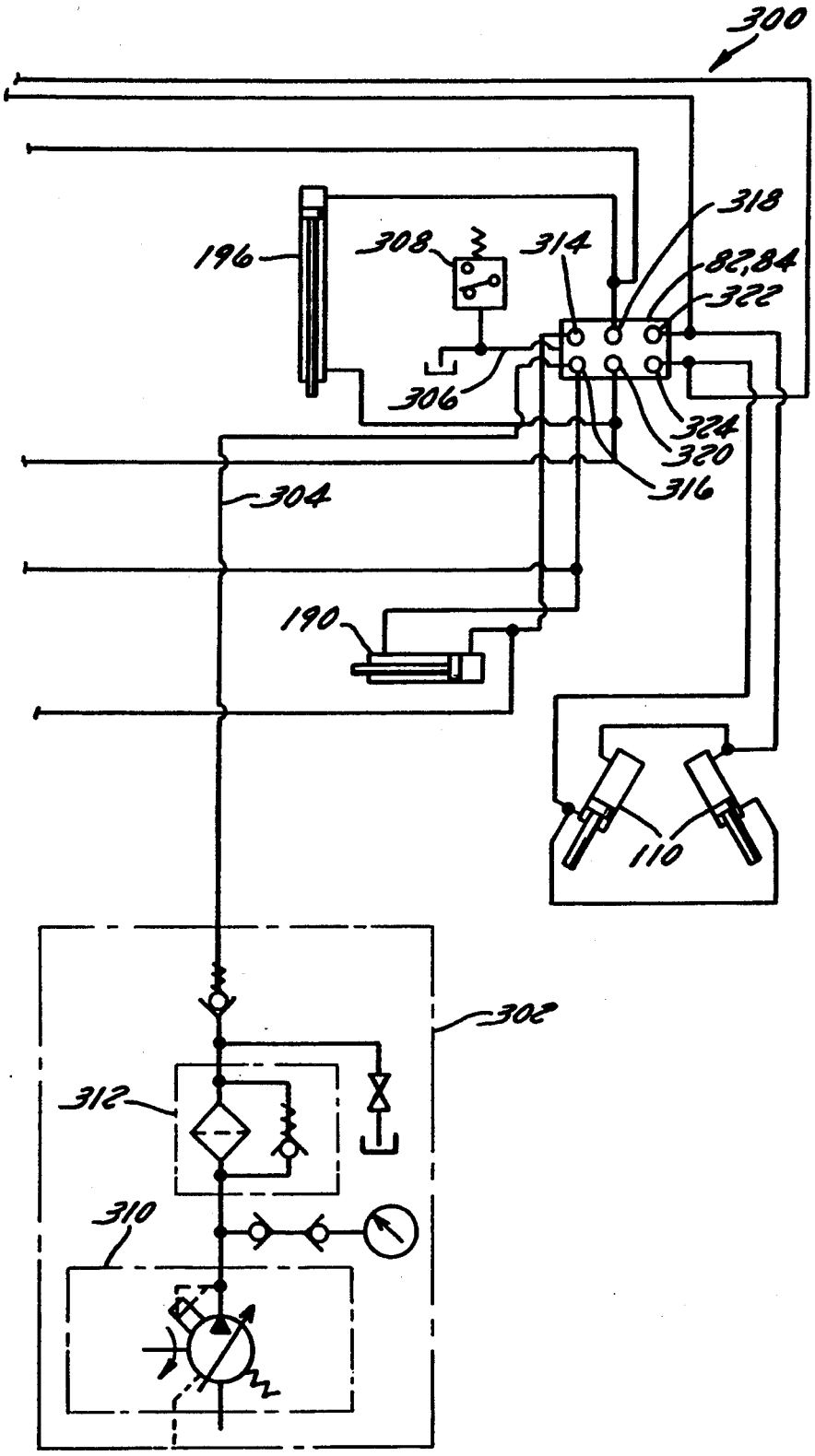
FIG. 14 is a hydraulic circuit diagram of the clip setting machine of FIGS. 1–12.

Referring now to FIGS. 3, 13, and 14, the clip stack support cylinders 148, dispensing cylinders 140, and clip retaining cylinders 172 of each workhead 36, 38 are preferably controlled by respective first, second, and third pneumatic valves 72, 74, and 76 described briefly above. The clamping cylinders 110, clip setting cylinders 190, and lift cylinders 196 are likewise controlled by a valve block 82 supported on a common manifold 84, also described briefly above. All of these valves are controlled by a common controller or ECU (not shown). Each of the valves preferably comprises a four-way two-position solenoid valve selectively supplying pressurized fluid to the piston and cylinder ends of the respective cylinders while venting the other of the piston and cylinder ends. preferred pneumatic and hydraulic circuits 250 and 300 including these valves will now be described.

Referring now to FIG. 13, pneumatic circuit 250 includes a pressure source 252, a pressure control device 254, the valves 72, 74, 76 and manifolds, 78, 80, and monitors 256 and 258. Each of the valves 72, 74 and 76 has an inlet port connected to a common supply line 276, control ports connected to the piston and cylinder ends of the respective cylinder, and an exhaust port connected to atmosphere. An accumulator 260 is disposed in supply line 276 between the pressure control device 254 and the valves 72, 74, and 76.

Pressure source 252 and pressure control device 254 may comprise any devices capable of supplying pressurized air at a desired pressure. In the illustrated embodiment, pressure source 252 includes a compressor 262 and a pressure limiter 264 controlled by the monitor 256 (preferably comprising a flow switch) in a manner which is, per se, well known. Pressure control device 254 includes a flow control valve 266, an accumulator 268, and a pressure limiter 270. A check valve 272 separates the pressure control device 254 from the accumulator 260, and a dump valve 274 is provided to permit selective depressurization of accumulator 260.

Each valve 72, 74, 76 is operable to selectively connect one of the control ports to the supply line 276 and to connect the other control port to atmosphere. Each of the valves 74, 76 is preferably coupled directly to the cylinders 140, 172 of both dispensing or clip setter assemblies of an associated workhead 36 or 38, and each valve 72 is similarly connected to all four clip stack cylinders 148 of each workhead indirectly via the manifold 78 and 80.

Referring now to FIG. 14, hydraulic circuit 300 includes, in addition to the valve block 82 and the manifold 84, a pressure source 302, a common supply line 304, and a common vent or exhaust line 306. A monitor 308 is provided in exhaust line 306 for reasons detailed below. Pressure source 302 is conventional and includes a pump assembly 310 and a suitable filtration system 312. Other portions of the circuit 300, not shown, are likewise conventional and control positioning of the chassis 12 and raising and lowering of the workheads 36 and 38 via lift cylinders 40, 42. A discussion of these other portions and of the pressure source 302 is omitted for the sake of brevity.

Valve block 82 preferably comprises 6 ports 314, 316, 318, 320, and 324, each of which is coupled to the piston/or cylinder ends of all of the corresponding cylinders 110, 190, and 196 mounted on a given workhead 36, 38. The individual connections are believed to be easily constructed by those skilled in the art and, accordingly, will not be described in further detail.

The circuits 250 and 300 of each workhead 36, 38 are preferably controlled such that the solenoid valves 72 for the clip stack lift cylinder 148 of the clip dispensing assemblies 64 and 66 of both workheads 36, 38 are energized by the manual actuation of a lever or switch, and such that the valves for the remaining cylinders of both workheads are sequentially and automatically energized upon full extension of the preceding cylinder. The term "full extension" as used herein with respect to the operation of a cylinder does not necessarily mean that the piston has been extended from the cylinder by its maximum possible amount. Rather, this term means that further movement of the piston in a direction resulting in actuation of the associated device is prevented either by maximum piston stroke into or out of the cylinder or by engagement of the device operated by the piston with some element inhibiting further piston or cylinder movement.

Many devices could be used to provide the desired sequential and automatic operation of the cylinders. For instance, an ECU could receive signals from limit switches, pressure switches, or the like and trigger sequential operation using a suitable control logic. A more simplified construction is preferred however, in which the controllers comprise fluid flow switches 258 and 308 which are closed when the fluid flow changes in the associated line 276 or 306 upon full cylinder or piston extension as defined above, thereby completing a circuit supplying power to the next solenoid valve.

The operation of the circuits 250 and 300 under the control of the flow switches 258 and 308 is believed to be self-evident from the above discussions and will not be described in detail. Suffice it to say that these switches, upon actuation of the main control switch and operation of the clip stack lift cylinders 148, cooperate with the ECU to actuate the cylinders of each of the workheads 36, 38 in the following sequence:

1. retraction of the dispensing cylinder 140;
2. retraction of the retaining cylinder 172;
3. retraction of the clip setting cylinder 190;
4. extension of the lift cylinder 196;
5. extension of the clip setting cylinder 190;
6. extension of the retaining cylinder 172;
7. retraction of the clip setting cylinder 190;
8. retraction of the lift cylinder 196; and
9. extension of the clip setting cylinder 190.

In addition, the dispensing cylinders 140 are extended and the clip stack lift cylinders 148 are retracted in any suitable manner between Step No. 4 and Step No. 9.

Many changes and modifications could be made to the present invention without departing from the spirit and scope thereof. The scope of such changes will become apparent from the appended claims.

We claim:

1. An apparatus for setting spring-type rail clips in sockets located on raiload ties supporting a rail, and apparatus comprising:

A. a magazine which stores said clips; and

B. a clip setter assembly which receives said clips from said magazine, said clip setter assembly including means for loosely setting said clips in said sockets and for subsequently moving away from said sockets without having fully tensioned said clips onto said rail.

2. An apparatus as defined in claim 1, further comprising a clip dispensing assembly which dispenses individual clips to said clip setter assembly, said clip dispensing assembly including said magazine and A. means for separating a clip from a stack of clips stored in said magazine;

B. means for discharging said separated clip from said magazine; and

C. means for conveying said separated clip from said magazine to said clip setter assembly.

3. An apparatus as defined in claim 2, wherein said means for discharging comprises:

(1) a trap door movably mounted on a bottom of said magazine, and (2) a dispensing cylinder which is connnected to said trap door.

4. An apparatus for setting spring-type rail clips in sockets located on railroad ties supporting a rail, said apparatus comprising:

A. a magazine which stores said clips;

B. a clip setter assembly which receives said clips from said magazine and which sets said clips in said sockets without fully tensioning said clips onto said rail; and C. a clip dispensing assembly which dispenes individual clips to said clip setter assembly, said clip dispensing assembly including (1) said magazine, (2) means for separating a clip from a stack of clips stored in said magazine, (3) means for discharing said separated clip from said magazine, and (4) means for conveying said separated clip from said magazine to said clip setter assembly, wherein said means for separating comprises a clip latch which extends into said magazine and which is pivotable to as to lift the remaining clips of said stack off from said separated clip, and a latching cylinder connected to said clip latch.

5. An apparatus for setting spring-type rail clis in sockets located on railraod ties supporting a rail, said apparatus comprising:

A. a magazine which stores said clips;

B. a clip setter assembly which receives said clips from said magazine and which sets said clips in said sockets without fully tensioning said clips onto said rail; and C. a clip dispensing assembly which dispenses individual clips to said clip setter assembly, said clip dispensing assembly including ( 1) said magazine, (2) means for separating a clip from a stack of clips stored in said magazine, (3) means for discharing said separated clip from said magazine, and (4) means for conveying said separated clip from said magazine to said clip setter assembly, wherein said means for conveying comprises a roller conveyor extending from a position beneath said magazine to a position in which said separated clip is accessible by said clip setter assembly.

6. An apparatus as defined in claim 5, wherein said clip setter assembly comprises a clip setting tool which comprises (1) a clip holder which receives said clip from said means for conveying, and (2) a pivotal clip retainer which selectively secures said clip in said clip holder for transport.

7. An apparatus as defined in claim 6, wherein said clip setter assembly further comprises (1) a support frame on which said clip setting tool is mounted for horizontal movement;

(2) a guide block on which said support frame and said clip setting tool are mounted for vertical movement, (3) a clip setting cylinder which drives said support frame and said clip setting tool to move horizontally; and (4) a lift cylinder which drives said guide block, said support frame, and said clip setting tool to move vertically.

8. An apparatus as defined in claim 7, further comprising a lateral adjustment bar, an adjustable retaining plate, and a support block.

9. An apparatus for setting spring-type rail clips in sockets located on railroad ites supporting a rail, said apparatus comprising:

A. a support frame;

B. a workhead which is mounted on said support frame and which is vertically moveable with respect to said support frame;

C. rail head guide wheels, mounted on said workhead, for movably supporting said workhead on a head of said rail;

D. rail clamps which clamp said workhead onto said rail;

E. a magazine which is mounted on said workhead and which stores and clips; and

F. a clip setter assembly which is mounted on said workhead and which receives said clips from said magazine, said clip setter assembly including means for loosely setting said clips in said sockets and for subsequently moving away from said sockets without having fully tensioned said clips onto said rail.

10. An apparatus as defined in claim 9, wherein each of said rail clamps comprises (1) a clamping arm pivotally attached to said workhead and having upper and lower ends,
(2) a clamping cylinder attached to said upper end of said arm, and
(3) a clamping roller which is rotatably mounted on said lower end of said clamping arm and which engages said rail when said clamping cylinder is actuated.

11. An apparatus as defined in claim 9, wherein said clip setter assembly comprises a clip setting tool which is movable both vertically and horizontally with respect to said magazine.

12. An apparatus as defined in claim 9, wherein said magazine and said clip setter assembly are positioned of a field side of said workhead, and further comprising a second magazine and a second clip setter assembly positioned on a gauge side of said workhead.

13. An apparatus as defined in claim 9, wherein said workhead is positionable over a first rail, and further comprising a second workhead which is mounted on said support frame and which is positionable over a second rail.

14. An apparatus for setting spring-type rail clips in sockets located on railroad ties supporting a rail, said apparatus comprising:
A. a support frame;
B. a workhead which is mounted on said support frame and which is vertically moveable with respect to said support frame;
C. rail head guide wheels, mounted on said workhead, for movably supporting said workhead on a head of said rail;
D. rail clamps which clamp said workhead onto said rail;
E. a magazine which is mounted on said workhead and which stores said clips; and
E. a clip setter assembly which is mounted on said workhead, and which receives said clips from said magazine, which sets said clips in said sockets without fully tensioning said clips onto said rail, wherein said clip setter assembly comprises a clip setting tool which is movable both vertically and horizontally with respect to said magazine, and wherein said clip setting tool comprises
(1) a clip hodler, and
(2) a pivotal clip retainer which selectively secures said clip in said clip holder for transport.

15. An apparatus as defined in claim 14, wherein said clip setter assembly further comprises
(1) a support frame on which said clip setting tool is mounted for horizontal movement;
(2) a guide block on which said support frame and said clip setting tool are mounted for vertical movement,
(3) a clip setting cylinder which drives said support frame and said clip setting tool to move horizontally, and
(4) a lift cylinder which drives said guide block, said support frame, and said clip holder to move vertically.

16. An apparatus as defined in claim 15, further comprising a retaining plate and an adjustment block via which said clip setter assembly is supported on said workhead and which permit adjustment of the position of said clip setter assembly with respect to said workhead.

17. A method of setting spring-type rail clips in sockets located on railroad ties supporting a rail, said method comprisng:
A. feeding a rail clip from a magazine to a clip setting tool;
B. moving said clip setting tool and said clip into alignment with said socket, and then
C. moving said clip setting tool toward said socket so as to set said clip in said socket and then moving said clip setting tool away from said socket without having fully tensined said clip onto said rail.

18. A method as defined in claim 17, wherein said feeding step comprises
(1) lifting a stack of clips in said magazine off from said clip, then
(2) dispensing said clip from said magazine, and then
(3) conveying said clip from said magazine to said clip setting tool.

19. A method as defined in claim 17, wherein
(1) said step B. comprises
(A) moving a clip holder of said clip setting tool horizontally away from said magazine, and then
(B) lowering said clip holder into alignment with said socket, and
(2) said step C. comprises moving said clip holder horizontally towards said socket.

20. A method as defined in claim 17, wherein said magazine and said clip setting tool are mounted on a workhead, and further comprising, prior to said feeding step, the steps of
A. lowering said workhead onto said rail;
B. moving said workhead along said rail; and
C. longitudinally and laterally aligning said workhead and said socket with one another.

21. A method of setting spring-type rail clips in sockets located on railroad ties supporting a rail, said method comprising:
A. lowering a workhead onto said rail, a matazine and a clip setting tool being mounted on said workhead;
B. moving said workhead along said rail; and
C. longitudinally and laterally aligning said worked and said socket with one another;
D. one of laterally and pivotably aligning said clip setting tool with said socket;
E. feeding a rail clip from said magazine to said clip setting tool;
F. moving said clip setting tool and said clip into alignment with said socket, and then
G. moving said clip setting tool toward said socket so as to set said clip in said socket, wherein said feeding step comprises
(1) lifting a stack of clips in said magazine off from said clip, then
(2) dispensing said clip from said magazine, and then
(3) conveying said clip from said magazine to said clip setting tool.

22. A method of setting a spring-type rail clip in a socket located on a railroad tie supporting a rail, said method comprising:
A. actuating a clamping cylinder to clamp a workhead to said tie, said workhead supporting a magazine and a clip setting tool;
B. positioning said workhead over said tie;
C. actuating a stack holding cylinder to lift a stack of clips from said clip in said magazine; then D. actuating an anchor dispensing cylinder to open a trap door to dispense said clip from said magazine; then E. conveying said clip to a clip holder of said clip setting too; and then F. actuating a clip setting cylinder to move said clip setting tool to insert said clip into said socket.

23. A method as defined in claim 22, wherein said clip setting cylinder moves said clip setting tool horizontally, and further comprising actuating a lift cylinder to vertically lower said clip setting tool into alignment with said socket prior to said step F.

24. A method as defined in claim 23, further comprising actuating said clip setting cylinder to move said clip setting tool away from said magazine after said step E. and before said step of vertically lowering.

25. A method as defined in claim 22, further comprising, after said step E., actuating a retaining clyinder to move a clip retainer of said clip setting tool into a position retaining said clip in said clip holder to said clip setting tool.

* * * * *